US010820667B2

(12) United States Patent
Kikukawa et al.

(10) Patent No.: US 10,820,667 B2
(45) Date of Patent: Nov. 3, 2020

(54) FASTENER STRINGER PROVIDED WITH METAL ELEMENT ROW HAVING PLATING FILM, FASTENER CHAIN, AND SLIDE FASTENER

(71) Applicant: YKK Corporation, Tokyo (JP)

(72) Inventors: Norio Kikukawa, Toyama (JP); Koji Hashiba, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/467,974

(22) PCT Filed: Sep. 20, 2017

(86) PCT No.: PCT/JP2017/033993
§ 371 (c)(1),
(2) Date: Jun. 9, 2019

(87) PCT Pub. No.: WO2018/110019
PCT Pub. Date: Jun. 21, 2018

(65) Prior Publication Data

US 2020/0085150 A1 Mar. 19, 2020

(30) Foreign Application Priority Data

Dec. 13, 2016 (WO) ..... PCT/JP2016/087127

(51) Int. Cl.
*A44B 19/42* (2006.01)
*A44B 19/06* (2006.01)

(52) U.S. Cl.
CPC ..... *A44B 19/06* (2013.01)

(58) Field of Classification Search
CPC ..... A44B 19/06; A44B 19/42
See application file for complete search history.

(56) References Cited

U.S. PATENT DOCUMENTS 2,334,054 A 11/1943 Wooters
2,517,907 A 8/1950 Mikulas
(Continued)

FOREIGN PATENT DOCUMENTS

CN 101608328 B 7/2011
CN 102828213 B 1/2016
(Continued)

OTHER PUBLICATIONS

International Preliminary Report on Patentability , PCT Application No. PCT/JP2017/033993, dated Jun. 27, 2019.
(Continued)

*Primary Examiner* — Jason W San
(74) *Attorney, Agent, or Firm* — Kilpatrick Townsend & Stockton LLP

(57) ABSTRACT

Provided is a fastener stringer including a row of metal elements having a plating film formed with improved thickness uniformity without waste, even if the elements are not electrically connected to each other in advance. For each of ten adjacent metal elements of the fastener stringer, $0.6 \leq D_1/A_1 \leq 2.0$ is satisfied in which $A_1$ represents an average value of thickness of the plating film for the ten metal elements at element center on either one main surface side of the fastener tape, and $D_1$ represents thickness of the plating film for each of the metal elements at the element center on the one main surface side of the fastener tape.

20 Claims, 9 Drawing Sheets

(56) References Cited

U.S. PATENT DOCUMENTS

| | | | | |
|---|---|---|---|---|
| 2,991,528 | A | 7/1961 | McNamara | |
| 5,297,319 | A * | 3/1994 | Akashi | A44B 19/34 24/405 |
| 7,208,073 | B1 | 4/2007 | Hradil | |
| 10,238,187 | B2 * | 3/2019 | Yamamoto | A44B 19/403 |
| 2003/0110600 | A1 * | 6/2003 | Kikukawa | B32B 15/01 24/399 |
| 2011/0114478 | A1 | 5/2011 | Lee | |
| 2017/0251772 | A1 * | 9/2017 | Yamamoto | A44B 19/403 |
| 2017/0311684 | A1 * | 11/2017 | Asami | A44B 19/06 |
| 2020/0085150 | A1 * | 3/2020 | Kikukawa | A44B 19/06 |

FOREIGN PATENT DOCUMENTS

| | | | |
|---|---|---|---|
| CN | 102839405 | B | 3/2016 |
| CN | 105755515 | A | 7/2016 |
| EP | 1 066 895 | A2 | 1/2001 |
| JP | S55-004072 | U | 1/1980 |
| JP | H05-239699 | A | 9/1993 |
| JP | H08-3158 | B2 | 1/1996 |
| JP | 2514760 | B2 | 7/1996 |
| JP | H08-209383 | A | 8/1996 |
| JP | 3087554 | B2 | 9/2000 |
| JP | 2001-8714 | A | 1/2001 |
| JP | 2003-193293 | A | 7/2003 |
| JP | 2004-76092 | A | 3/2004 |
| JP | 2004-100011 | A | 4/2004 |
| JP | 2005-256131 | A | 9/2005 |
| JP | 2005-272875 | A | 10/2005 |
| JP | 2008-202086 | A | 9/2008 |
| JP | 5063733 | B2 | 10/2012 |

OTHER PUBLICATIONS

International Search Report, PCT Application No. PCT/JP2017/133993, dated Oct. 24, 2017.

International Search Report, PCT Application No. PCT/JP2016/087127, dated Mar. 14, 2017.

Supplementary European Search Report, European Patent Application No. 17879846.8, dated Jul. 30, 2020.

Supplementary European Search Report, European Patent Application No. 17880956.2, dated Jul. 31, 2020.

Supplementary European Search Report, European Patent Application No. 17881625.2, dated Jul. 30, 2020.

* cited by examiner

FASTENER STRINGER PROVIDED WITH METAL ELEMENT ROW HAVING PLATING FILM, FASTENER CHAIN, AND SLIDE FASTENER

TECHNICAL FIELD

The present invention relates to a metal fastener. More particularly, the present invention also relates to a fastener stringer including a metal element row having a plating film, a fastener chain, and a slide fastener.

BACKGROUND ART

Some slide fasteners include element rows made of a metal, and such slide fasteners are generally referred to as "metal fasteners". The metal fasteners are generally produced via an intermediate product called a fastener chain which is formed by engaging metal element rows fixed to opposing side edges of a pair of elongated fastener tapes. The fastener chain is cut at a predetermined length, and various parts such as a slider, upper stoppers, a lower stopper and the like are attached to complete the metal fastener.

The metal fasteners often use copper alloys or aluminum alloys, and are suitable for designs that take advantage of color and texture of metals. Recently, there are various needs of user for the design of the metal fastener, and various color tones are required depending on applications. One of methods for changing the color tone of a metal product is electroplating. In the electroplating method, an object to be plated is immersed in a plating solution and energization is conducted to form a plating film on a surface of the object to be plated.

Most electroplating methods for metal fasteners use barrel plating in which an object to be plated is placed in a barrel, the barrel is introduced into a plating solution, and electroplating is carried out while rotating the barrel (e.g., Japanese Patent Application Publication No. 2004-1000011 A, Japanese Patent Application Publication No. 2008-202086 A, Japanese Patent No. 3087554 B, and Japanese Patent No. 5063733 B).

Further, as an electroplating method for an elongated product, a method is known in which electroplating is carried out while continuously conveying the elongated product in a plating bath (e.g., Japanese Patent Application Publication No. 2004-76092A, Japanese Patent Application Publication No. H05-239699 A, and Japanese Patent Application Publication No. H08-209383 A).

However, the above methods do not consider specificities of the metal fasteners. In the metal fastener, adjacent elements are not electrically connected to each other, so that it is difficult to electroplate uniformly each element by the above method. Therefore, to plate the metal fastener, a method is proposed in which a fastener chain is produced in a state where elements have been electrically connected in advance, and the fastener chain is continuously subjected to electroplating. For example, Japanese Patent No. 2514760 B proposes to produce a fastener chain in a state where elements are electrically connected, by knitting conductive yarns into an element attachment portion of a fastener tape.

However, although the method as described in Japanese Patent No. 2514760 B can simultaneously carry a current to the entire element row to electroplate it continuously, it has a problem that the conductive yarn is expensive, and the conductive yarn is easily cut and the metal is easily dissolved in preparation and dying of the tape due to knitting of the metal conductive yarn, so that productivity is poor.

As a technique for electroplating elements of a slide fastener chain without using the conductive yarn, a feeding drum method is known. For example, Japanese Examined Patent Application Publication No. H08-3158 A discloses a method for surface-treating both front and back sides of an element by axially supporting a pair of feeding drums each having a predetermined structure in parallel, and providing a positive electrode on one side of a feeding drum A and providing a positive electrode on the other side of another feeding drum B so as to be opposite to each other, and connecting a negative electrode to feeding shafts of the feeding drums A and B, in which a slide fastener chain C having metal elements is first pressed on and passed through the one side of the feeding drum A and is then pressed on and passed through the other side of the feeding drum B.

Further, Chinese Patent No. 102839405 B discloses an electroplating device for elements of a fastener chain, comprising: an arc-shaped guide rail for housing and guiding a fastener tape, wherein a conductive portion of an outer periphery of the guide rail connected to a power supply is brought into contact with bottom portions of the elements during housing of the fastener tape.

CITATION LIST

Patent Literatures

Patent Document 1: Japanese Patent Application Publication No. 2004-100011 A

Patent Document 2: Japanese Patent Application Publication No. 2008-202086 A

Patent Document 3: Japanese Patent No. 3087554 B

Patent Document 4: Japanese Patent No. 5063733 B

Patent Document 5: Japanese Patent Application Publication No. 2004-76092 A

Patent Document 6: Japanese Patent Application Publication No. H05-239699 A

Patent Document 7: Japanese Patent Application Publication No. H08-209383 A

Patent Document 8: Japanese Patent No. 2514760 B

Patent Document 9: Japanese Examined Patent Application Publication No. H08-3158 B Patent Document 10: Chinese Patent No. 102839405 B

SUMMARY OF INVENTION

Technical Problem

The feeding drum method tends to result in non-uniform contact of the feeding drum with the elements, so that it is necessary to repeat multiple contacting with the feeding drum in order to eliminate elements on which a plating film has not been formed. However, a large number of repetitions of contacting with the feeding drum causes a problem of resulting in large variation in thickness of the plating film. The large variation in thickness of the plating film results in appearance appearing to be uniform color tone, but quality such as corrosion resistance, abrasion resistance and discoloration resistance depending on types of plating varies for each element, resulting in deterioration starting from an element with a thinner plating film. Further, a large difference of the thickness of the plating film does not provide any fixed sliding resistance in operation of a slider, causing the user to feel discomfort. Therefore, the metal fastener having the large variation in thickness of the plating film on the element cannot be a high-quality metal fastener.

Furthermore, the barrel plating has a risk that a large number of elements will mesh with one another during rotation of the elements in the barrel. If they mesh with one another until the end of the plating process, they can be removed as defects. However, if the meshing is released in the middle of the process, the film thickness of the meshed part will be decreased.

Therefore, it is difficult to form a highly uniform plating film as designed. Moreover, in the barrel plating, the plating film is formed on the entire surface of the element, so that plating is also formed on a surface portion of the element that is not visible after being implanted in the fastener tape, which will waste the plating solution. Further, the implanting of the elements in the fastener tape before being plated tends to result in deformation of the elements and generation of cracks in a step of caulking the elements. The cracks lead to poor appearance and also tend to generate discoloration originated from the cracks.

The present invention has been made in view of the above circumstances. An object of the present invention is to provide a fastener stringer, a fastener chain and a slide fastener including a metal element row having a plating film formed with improved thickness uniformity and without waste on the surface of the elements even if the elements are not electrically connected to each other in advance.

Further, the feeding drum method causes a problem that a plating deposition property is poor at engaged portions (a convex portion and a concave portion) of element head portion. Therefore, another object of the present invention is to provide a fastener stringer, a fastener chain and a slide fastener including a metal element row having a plating film having an improved plating deposition property at the engaged portions (a convex portion and a concave portion) of each element head portion even if the elements are not electrically connected to each other in advance.

Solution to Problem

The present inventor has conducted intensive studies in order to solve the above problems, and found that it is effective to bring each metal element fixed to a fastener chain into contact with a plurality of conductive media flowably accommodated and apply a current via the conductive media while traveling the fastener chain in a plating solution. Then, the present inventor has found that, by ensuring the contacting of the metal elements with the plating solution while disposing the conductive media on one main surface side of the fastener chain without disposing the conductive media on the other main surface side when the metal elements are brought into contact with the conductive media, a plating film is grown with high uniformity on the surface on the other main surface side and the plating deposition property at the engaged portions (a convex portion and a concave portion) of the element head portion is significantly improved.

The present invention completed based on the above findings is illustrated as follows:

[1]

A fastener stringer comprising a row of metal elements having a plating film, the metal elements being fixed at predetermined intervals on one side edge of a fastener tape in a longitudinal direction, wherein a portion of the fastener tape in contact with each of the metal elements has insulation properties;

each of the metal elements comprises: a pair of leg portions; and a head portion connecting the pair of leg portions, the head portion comprising a convex portion and a concave portion for engagement;

the plating film is not formed on a portion which is hidden by contact with the fastener tape, among the surface of each of the metal elements;

the row of the metal elements is composed of 2n or 2n+1 metal elements in which n is an integer of 5 or more; and each of ten adjacent metal elements from the $n-4^{th}$ to the $n+5^{th}$ in the longitudinal direction from either one end of the row of metal elements satisfies a relationship: $0.6 \leq D_1/A_1 \leq 2.0$, in which $A_1$ represents an average value of thickness of the plating film for the ten metal elements at element center on either one main surface side of the fastener tape, and $D_1$ represents thickness of the plating film for each of the ten metal elements at the element center on the one main surface side of the fastener tape.

[2]

The fastener stringer according to [1], wherein the average value $A_1$ of the thickness of the plating film is 0.05 μm or more.

[3]

The fastener stringer according to [1] or [2], wherein for each of the ten metal elements, the plating film is formed such that a base material is not exposed at the top of the convex portion and at the deepest point of the concave portion of the head portion.

[4]

The fastener stringer according to any one of [1] to [3], wherein for each of the ten metal elements, thickness of the plating film at the top of the convex portion and at the deepest point of the concave portion of the head portion is respectively 30% or more relative to the thickness $D_1$ of the plating film at the element center on the one main surface side.

[5]

The fastener stringer according to any one of [1] to [4], wherein for each of the ten metal elements, thickness of the plating film at the top of the convex portion and at the deepest point of the concave portion of the head portion is 0.02 μm or more, respectively.

[6]

A fastener stringer comprising a row of metal elements having a plating film, the metal element being fixed at predetermined intervals on one side edge of a fastener tape in a longitudinal direction, wherein a portion of the fastener tape in contact with each of the metal elements has insulation properties;

each of the metal elements comprises: a pair of leg portions; and a head portion connecting the pair of legs, the head portion comprising a convex portion and a concave portion for engagement;

the plating film is not formed on a portion which is hidden by contact with the fastener tape, among the surface of each of the metal elements;

the row of the metal elements is composed of 2n or 2n+1 metal elements in which n is an integer of 5 or more; and for each of ten adjacent metal elements from the $n-4^{th}$ to the $n+5^{th}$ in the longitudinal direction from either one end of the row of metal elements, the plating film is formed such that a base material is not exposed at the top of the convex portion and at the deepest point of the concave portion of the head portion.

[7]

The fastener stringer according to [6], wherein for each of the ten metal elements, the thickness of the plating film at the top of the convex portion and at the deepest point of the concave portion of the head portion is respectively 30% or more relative to $D_1$, which represents thickness of the plating film for each of the metal elements at the element center on either one main surface side of the fastener tape.

[8]

The fastener stringer according to [6] or [7], wherein for each of the ten metal elements, the thickness of the plating film at the top of the convex portion and at the deepest point of the concave portion of the head portion is 0.02 μm or more, respectively.

[9]

The fastener stringer according to any one of [6] to [8], wherein each of the ten adjacent metal elements satisfies a relationship: $0.6 \leq D_1/A_1 \leq 2.0$, in which $A_1$ represents an average value of thickness of the plating film for the ten metal elements at element center on either one main surface side of the fastener tape, and $D_1$ represents thickness of the plating film for each of the metal elements at the element center on the one main surface side of the fastener tape.

[10]

The fastener stringer according to [9], wherein the average value $A_1$ of the thickness of the plating film is 0.05 μm or more.

[11]

The fastener stringer according to any one of [1] to [10], wherein the plating film is formed on an entire exposed surface of each of the ten metal elements.

[12]

The fastener stringer according to any one of [1] to [11], wherein the plating film is formed after the row of metal elements is fixed to one side edge of the fastener tape in the longitudinal direction at predetermined intervals.

[13]

A fastener chain comprising engaged rows of opposing metal elements of a pair of fastener stringers, wherein each of the fastener stringers is the fastener stringer according to any one of [1] to [12].

[14]

A slide fastener comprising the fastener chain according to [13].

[15]

An article comprising the slide fastener according to [14].

Advantageous Effects of Invention

According to the present invention, it is possible to obtain a metal fastener including rows of metal elements having a plating film formed with improved thickness uniformity without waste, even if the elements are not electrically connected to each other in advance. Further, according to another embodiment of the present invention, it is possible to obtain a metal fastener with improved plating deposition property at an engaged portion (a concave portion and a convex portion) of each element head portion, even if the elements are not electrically connected to each other in advance. Thus, the present invention enables to provide a low-cost and high-quality plating film to the elements of the metal fastener, and significantly contributes to enabling proposal of inexpensive fastener products having a wide variety of color tones to users.

DESCRIPTION OF THE PREFERRED EMBODIMENTS

Hereinafter, embodiments of the present invention will be described in detail with reference to the drawings.

(1. Metal Fastener)

Figure 1:
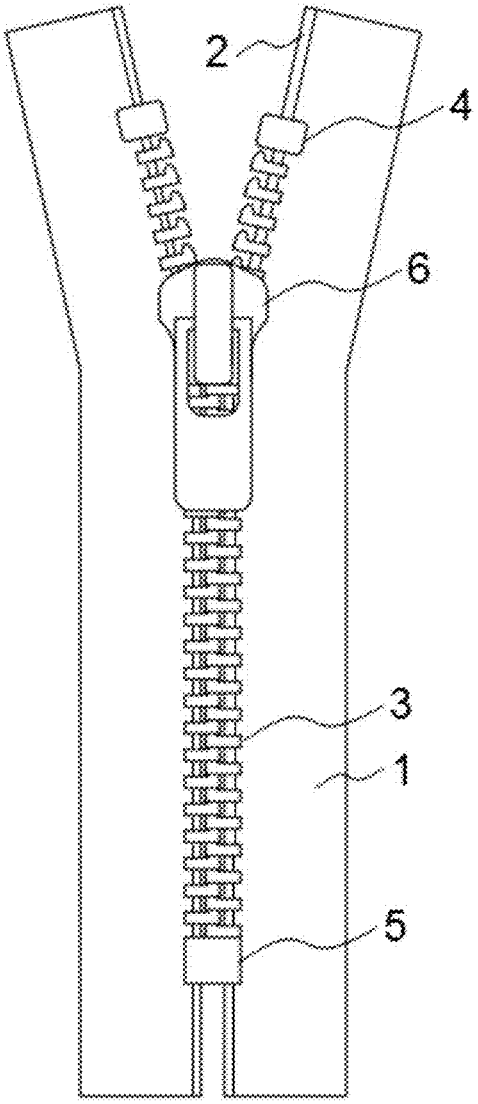
FIG. 1 is a schematic front view of a metal fastener.

FIG. 1 exemplarily shows a schematic front view of a metal fastener. As shown in FIG. 1, the metal fastener includes rows of metal elements 3 having a plating film, fixed to one side edge of each of fastener tapes 1 at predetermined intervals in a longitudinal direction. An article in which the row of the elements 3 has been fixed to one side edge of one fastener tape 1 is referred to as a fastener stringer, and an article in which the rows of opposing elements 3 of a pair of fastener stringers have been engaged with each other is referred to as a fastener chain.

In one embodiment, each metal element forming the rows of the elements 3 is caulked and fixed (attached) to core portions 2 each formed on an inner edge side of the fastener tape 1. Further, the metal fastener can include: upper stoppers 4 and a lower stopper 5 caulked and fixed to the core portions 2 of the fastener tapes 1 at upper ends and lower ends of the rows of the metal elements, respectively; and a slider 6 inserted between the rows of the pair of opposing elements 3 and slidable in an up and down direction for engaging and disengaging the pair of metal elements 3. The lower stopper 5 may be an openable, closable and fittingly insertable tool consisting of an insert pin, a box pin and a box body, so that the pair of slide fastener chains can be separated by engaging and disengaging operations of the slider. Other embodiments that are not shown are also possible.

Figure 2:
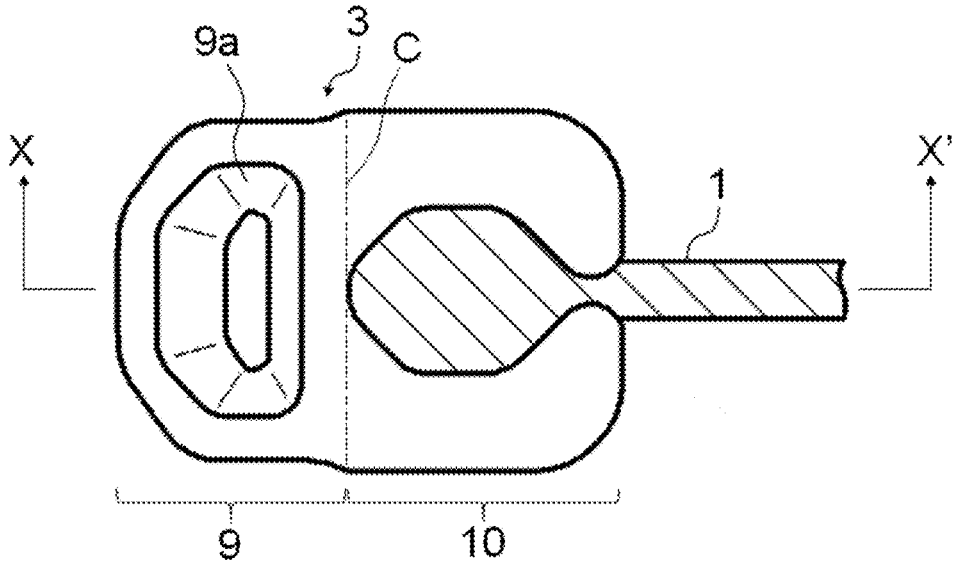
FIG. 2 is a schematic bottom view when metal elements are observed from a direction facing an arrangement direction.
Figure 3:
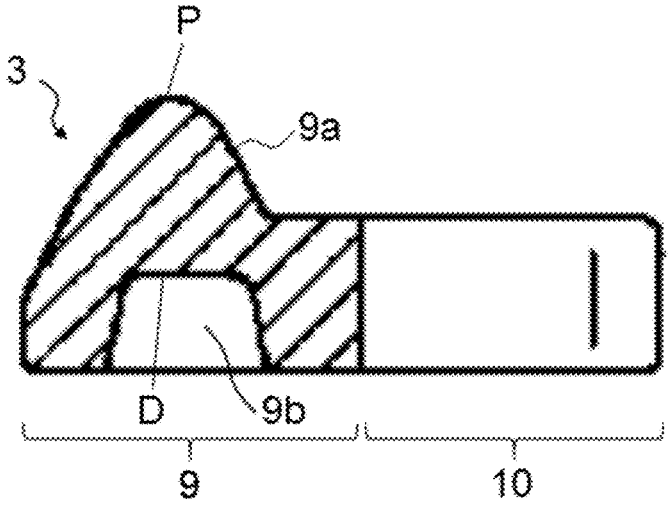
FIG. 3 is a cross-sectional view taken along the line X-X' in FIG. 2 (excluding a fastener tape).

FIG. 2 is a schematic bottom view when the metal elements 3 are observed from a direction facing its arrangement direction (the longitudinal direction of the fastener tape 1). FIG. 3 is a cross-sectional view (X-X' cross-sectional view in FIG. 2 excluding the fastener tape) when the metal element 3 is cut by a cut surface passing through a center in a front and back direction of the fastener tape 1. Each metal element 3 is provided with a pair of leg portions 10, and a head portion 9 for connecting the pair of leg portions 10, the head portion 9 including a convex portion 9*a* and a concave portion 9*b* for engagement. Here, a boundary between the leg portion 10 and the head portion 9 is a straight line extending in the in the front and back direction of the fastener tape 1, which passes through an inner peripheral portion closest to the head portion among the portions where the fastener tape 1 can enter between both leg portions 10, when the metal element is observed from a direction facing its arrangement direction (the longitudinal direction of the fastener tape 1) (see the dotted line C in FIG. 2).

In the metal fastener according to the present invention, a portion of the fastener tape 1 in contact with each metal element 3 has insulating properties, and has no conductive yarns woven, so that the adjacent elements are not electrically connected to each other. It is difficult for such a metal fastener to form a plating film having high thickness uniformity on the element 3. However, the present inventor has found a method that can uniformly feed power to each element forming the rows of the elements during electroplating. Therefore, it is possible to obtain a metal fastener having high uniformity of the plating film between the elements, and a high plate deposition property at engaged portions (the convex portion 9*a* and the concave portion 9*b*) of the head portion 9 of each element. Moreover, it is also possible to form a plating film on the entire exposed surface of each metal element 3.

In one embodiment of the metal fastener according to the present invention, the row of the metal elements 3 for forming each fastener stringer is composed of 2n or 2n+1 metal elements 3 in which n is an integer of 5 or more, and each of ten adjacent metal elements 3 from the $n-4^{th}$ to the $n+5^{th}$ in the longitudinal direction from either one end of the row of metal elements 3 satisfies the relationship: $0.6 \leq D_1/A_1 \leq 2.0$, preferably $0.6 \leq D_1/A_1 \leq 1.5$, more preferably $0.6 \leq D_1/A_1 \leq 1.4$, even more preferably $0.7 \leq D_1/A_1 \leq 1.3$, still more preferably $0.8 \leq D_1/A_1 \leq 1.2$, in which $A_1$ represents an average value of thickness of the plating film for the ten metal elements at element center on either one main surface side of the fastener tape 1, and $D_1$ represents thickness of the plating film for each of the metal elements at the element center on the one main surface side of the fastener tape 1.

The reason why the adjacent ten metal elements 3 from the $n-4^{th}$ to $n+5^{th}$ are to be measured is for stable film inspection and convenience. For example, in the case of a fastener chain in which 101 (2n+1=101, n=50) elements are fixed, elements from $n-4=50-4=46^{th}$ to $n+5=50+5=55^{th}$ as counted from either one end side of the fastener chain are to be measured.

In one preferable embodiment of the metal fastener according to the present invention, each of any given ten elements 3 aligned adjacent to each other along one side edge of the fastener tape 1 in the longitudinal direction also satisfies the relationship: $0.6 \leq D_1/A_1 \leq 2.0$, preferably $0.6 \leq D_1/A_1 \leq 1.5$, more preferably $0.6 \leq D_1/A_1 \leq 1.4$, even more preferably $0.7 \leq D_1/A_1 \leq 1.3$, still more preferably $0.8 \leq D_1/A_1 \leq 1.2$, in which $A_1$ represents an average value of thickness of the plating films for the given ten elements 3 at element center on either one main surface side of the fastener tape 1, and $D_1$ represents thickness of the plating film for each of the ten metal elements at the element center on the one main surface side of the fastener tape 1.

Figure 4:
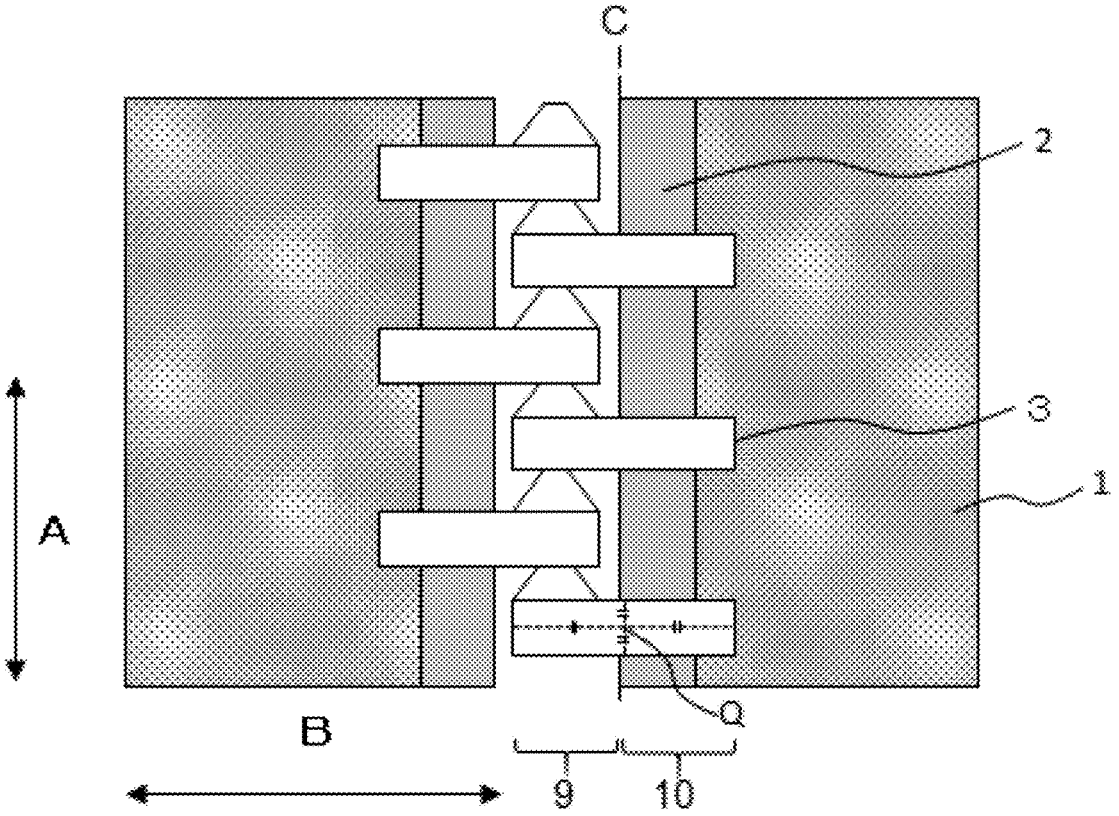
FIG. 4 is a partial schematic view when one (or the other) main surface of a fastener chain (or a fastener stringer) is observed from a direction perpendicular to the main surface.

As used herein, the element center on either one main surface side of the fastener tape 1 refers to an intersection portion Q of a straight line bisecting the element 3 in the longitudinal direction of the fastener tape 1 (the direction A in FIG. 4) and a straight line bisecting the element 3 in a direction perpendicular to the longitudinal direction (the direction B in FIG. 4), when the one main surface of the fastener chain (or a fastener stringer) is observed from the direction perpendicular to the one main surface.

The average value $A_1$ of the thickness of the plating film at the element center is not particularly limited and may be suitably changed in accordance with the type of plating. In view of wear resistance, it is preferably 0.05 μm or more, and more preferably 0.1 μm or more, and still more preferably 0.2 μm or more. On the other hand, in terms of suppressing sliding resistance of the slider and of suppressing plating costs, the average value is preferably 1 μm or less, and more preferably 0.5 μm or less, and even more preferably 0.3 μm or less.

Further, in one embodiment of the metal fastener according to the present invention, for each of the ten adjacent metal elements 3 from the $n-4^{th}$ to the $n+5^{th}$ configuring the fastener stringer, preferably for each of the any given ten elements 3 aligned so as to be adjacent to each other configuring the fastener stringer, a plating film is formed such that a base material does not appear at the top of the convex portion 9*a* and at the deepest point of the concave portion 9*b* of the head portion 9.

Furthermore, in one embodiment of the metal fastener according to the present invention, for each of the ten adjacent metal elements 3 from the $n-4^{th}$ to the $n+5^{th}$ forming the fastener stringer, preferably for each of any given ten elements 3 aligned so as to be adjacent to each other configuring the fastener stringer, thickness of the plating film at the top of the convex portion 9*a* and at the deepest point of the concave portion 9*b* of the head portion 9 is respectively 30% or more, preferably 40% or more, more preferably 45% or more, even more preferably 50% or more, for example from 40 to 150%, relative to the thickness $D_1$ of the plating film at the element center on the one main surface side.

Illustratively, for each of the ten adjacent metal elements 3 from the $n-4^{th}$ to the $n+5^{th}$ forming the fastener stringer, preferably for each of any given ten elements 3 aligned so as to be adjacent to each other forming the fastener stringer, thickness of the plating film at the top of the convex portion 9*a* and at the deepest point of the concave portion 9*b* of the head portion 9 can be 0.02 μm or more, and preferably 0.05 μm or more, and more preferably 0.1 μm or more, respectively. FIG. 3 illustrates the top of the convex portion 9*a* of the head portion 9 as P and the deepest point of the concave portion 9*b* as D.

For the metal elements, thickness of the plating film at the element center, the top of the convex portion 9*a* and the deepest point of the concave portion 9*b* of the head portion 9 is measured by obtaining an element depth profile with Auger electron spectroscopy (AES). Analysis conditions are as follows.

The thickness of the plating film at the element center Q of each element is determined by obtaining an element depth profile with Auger electron spectroscopy (AES). The thickness of the plating film is defined to be a depth at which a concentration of the plating metal element is half of the maximum value. Analysis conditions are as follows:

Acceleration Voltage: 10 kV;
Amount of Current: $3 \times 10^{-8}$ A;
Ion Gun: 2 kV;
Measuring Diameter: 50 μm;
Etching: measured every 20 seconds; and
Sample Inclination: 30°.

A detection depth is converted and calculated using an etching rate of 8.0 nm/in of the $SiO_2$ standard substance.

In addition, when the plating film is comprised of multiple elements such as alloy plating, the thickness of the plating film is evaluated by analyzing a metal element having the highest detection strength except for the main components making up the base material of the element. For example, when a Cu—Sn alloy plating film is formed on the surface of an element mainly comprised of Cu, the thickness of the plating film is measured based on Sn. Further, when a Co—Sn alloy plating film is formed on an element mainly comprised of Cu, the thickness of the plating film is measured based on either element having a higher detection intensity.

Materials of the metal elements 3 that can be used include, but not particularly limited to, copper (pure copper), copper alloys (e.g., copper alloys containing zinc (Cu—Zn alloys), such as red brass, brass, nickel white, and the like) and aluminum alloys (Al—Cu alloys, Al—Mn alloys, Al—Si alloys, Al—Mg alloys, Al—Mg—Si alloys, Al—Zn—Mg alloys, Al—Zn—Mg—Cu alloys and the like), zinc, zinc alloys, iron, iron alloys, and the like.

Various plating films can be formed on the surfaces of the metal elements. The plating can be performed aiming at a rust prevention effect, a crack prevention effect, and a sliding resistance reduction effect, in addition to the design purpose of obtaining a desired color tone. A type of plating is not particularly limited and may be any of single metal plating, alloy plating and composite plating. Examples of the plating includes Sn plating, Cu—Sn alloy plating, Cu—Sn—Zn alloy plating, Sn—Co alloy plating, Rh plating, and Pd plating. Further examples of the plating includes Zn plating (including a zincate treatment), Cu plating (including copper cyanide plating, copper pyrophosphate plating, and copper sulfate plating), Cu—Zn alloy plating (including brass plating), Ni plating, Ru plating, Au Plating, Co plating, Cr plating (including a chromate treatment), Cr—Mo alloy plating and the like. The type of plating is not limited to those, and other various metal plating can be performed in accordance with the purpose.

Non-limiting examples of the fastener tape 1 that can be used include fiber tapes such as woven tapes, knitted tapes and non-woven tapes, which have been conventionally used for the slide fasteners. Non-limiting examples of a material of the fiber that can be used includes polyester, nylon, polypropylene, acryls and the like, which have been conventionally used for the slide fasteners. According to one embodiment of the metal fastener according to the present invention, the portion of the fastener tape 1 in contact with each metal element 3 is at least insulating, and typically the fastener tape 1 is entirely insulating.

The slide fastener according to the present invention can be attached to various articles, and particularly functions as an opening/closing tool. The articles to which the slide fastener is attached include, but not limited to, daily necessities such as clothes, bags, shoes and miscellaneous goods, as well as industrial goods such as water storage tanks, fishing nets and space suites.

Figure 5:
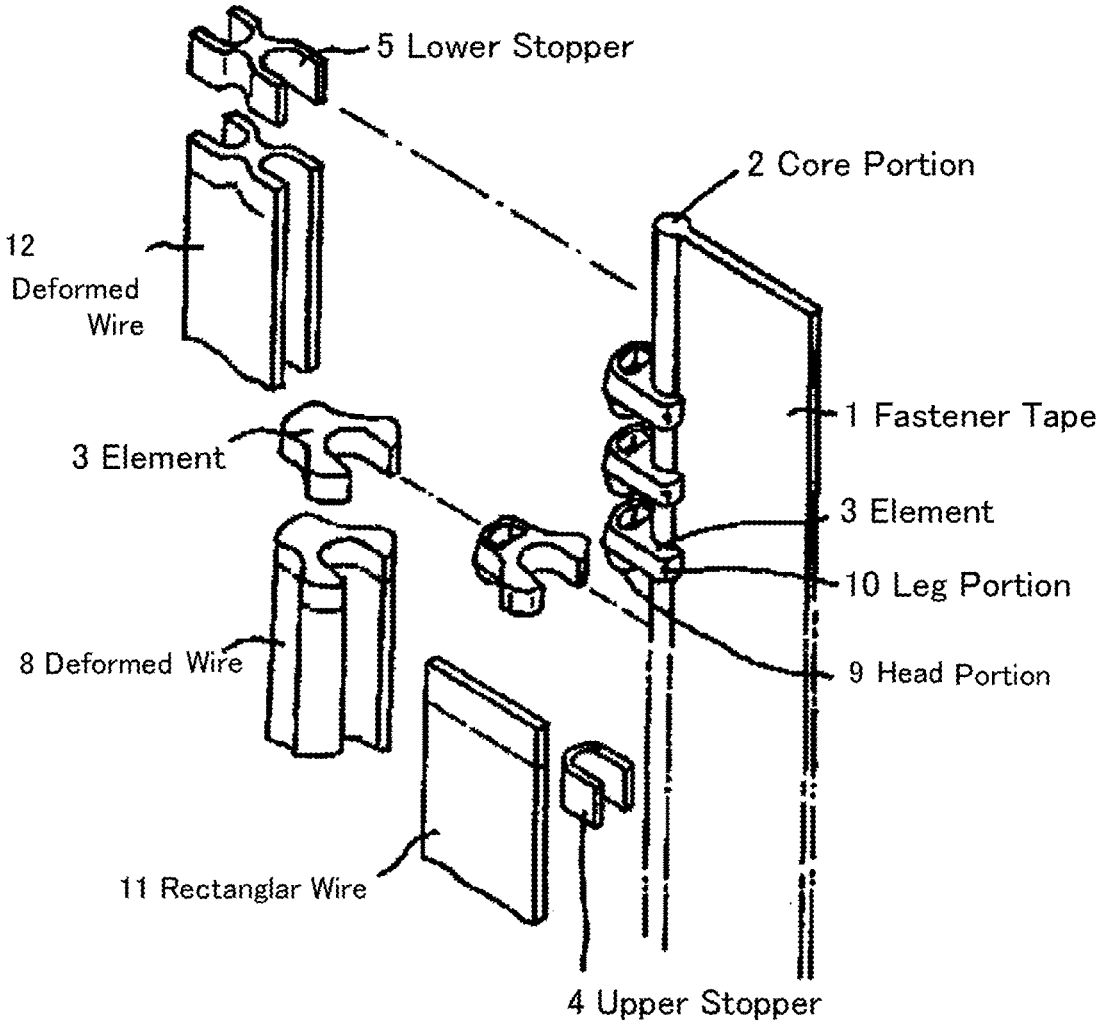
FIG. 5 is a view for explaining how to attach a lower stopper, upper stoppers and elements to a fastener tape.

FIG. 5 is a view showing a method for attaching the metal elements 3, the upper stopper 4 and the lower stopper 5 to the core portion 2 of the fastener tape 1. As shown in FIG. 5, the metal elements 3 are formed by cutting a deformed wire 8 formed through heat treatment and cold rolling steps, which has a substantially Y-shaped cross section, into pieces each having predetermined dimensions, and pressing the pieces to form the convex portion 9*a* and the concave portion 9*b* for engagement in the head portion 9, and are then attached to the core portion 2 by caulking both leg portions 10 onto the core portion 2 formed on one side edge of the fastener tape 1 in the longitudinal direction.

The upper stopper 4 is formed by cutting a rectangular wire 11 (a square wire) having a rectangular cross section into pieces each having predetermined dimensions, and bending the pieces to form a substantially C-shaped cross section, and is then attached to the core portion 2 by caulking the piece onto the core portion 2 of the fastener tape 1. The lower stopper 5 is formed by cutting a deformed wire 12 having a substantially X-shaped cross section 12 into pieces each having predetermined dimensions, and is then attached to the core portion 2 by caulking the piece onto the core portion 2 of the fastener tape 1.

It should be noted that FIG. 5 shows that the metal elements 3, the upper stopper 4 and the lower stopper 5 are simultaneously attached to the fastener tape 1. However, actually, the metal elements 3 are first attached intermittently to a predetermined region of the fastener tape 1 to form a fastener stringer, and opposing element rows of a pair of fastener stingers are engaged with each other to prepare a fastener chain. The predetermined upper or lower stopper 4, 5 is then attached in a region of the fastener chain with no element attached.

(2. Plating Method)

Hereinafter, a plating method for production of the metal fastener including metal element rows having a high deposition property of the plating film and high thickness uniformity of the plating film will be described. To consider industrial production, it is preferable to electroplate sequentially the fastener chain while conveying it.

According to the results of intensive studies, the present inventor has found that it is effective to bring each metal element fixed to the fastener chain into contact with a plurality of conductive media flowably accommodated and apply a current via the conductive media while traveling the fastener chain in a plating solution. When the metal elements are brought into contact with the conductive media, the contacting of the metal elements with the plating solution is ensured while disposing the conductive media on one main surface side of the fastener chain without disposing the conductive media on the other main surface side, so that a plating film can be effectively grown on a surface of the element on the other main surface side. That is, a current can be reliably applied to the individual elements by plating the metal elements on either side of the fastener chain.

In one embodiment, the electroplating method according to the present invention includes a step of passing the fastener chain through one or more first insulating containers while bringing each metal element into contact with a plating solution in a plating bath, each of the first insulating containers flowably accommodating a plurality of conductive media in electrical contact with a negative electrode, for the purpose of mainly plating the surface of the metal element row exposed on one main surface side of the fastener chain.

In another embodiment, the electroplating method according to the present invention further includes a step of passing the fastener chain through one or more second insulating containers while bringing each metal element into contact with a plating solution in a plating bath, each of the second insulating containers flowably accommodating a plurality of conductive media in electrical contact with a negative electrode, for the purpose of mainly plating the surface of the metal element row exposed on the other main surface side of the fastener chain.

By carrying out these two steps, it is possible to plate the surface of the metal element rows exposed on both main surface sides of the fastener chain. Moreover, by carrying out both of the steps using different plating solutions, it is also possible to form a plating film on one main surface of the fastener chain that is different from that on the other main surface.

In one embodiment of the fastener stringer according to the present invention, the rows of the metal elements are fixed to the fastener tapes and then plated, so that a plating film is not formed on a portion of the surface of each metal element which is hidden by contact with the fastener tape. This will lead to saving of the plating solution and contribute to reduction of production costs.

Conditions such as a composition and a temperature of the plating solution and the like may be appropriately set by those skilled in the art depending on types of metal components to be deposited on each metal element, and are not particularly limited.

Materials of the conductive media are not particularly limited, and are generally metals. Among the metals, iron, stainless steel, copper and brass are preferable, and iron is more preferable, because they have higher corrosion resistance and higher abrasion resistance. However, when using conductive media made of iron, the contact of the conductive media with the plating solution will lead to formation of a displacement-plating film having poor adhesion on surfaces of iron balls. The plating film peels off from the conductive media during electroplating of the fastener chain to form fine metal pieces which float in the plating solution. The floating of the metal pieces in the plating solution leads to adhesion to the fastener tapes, and it is thus preferable to prevent the floating. Therefore, when using the conductive media made of iron, it is preferable that the conductive media have been previously subjected to copper pyrophosphate plating, copper sulfate plating, nickel plating or tin-nickel alloy plating in order to prevent the displacement plating. Although the displacement plating can also be prevented by copper cyanide plating on the conductive media, it leads to relatively large irregularities on the surfaces of the conductive media so that rotation of the conductive media is inhibited. Therefore, copper pyrophosphate plating, copper sulfate plating, nickel plating, or tin-nickel alloy plating is preferred.

Materials of the first insulating container(s) and the second insulating container(s) include, preferably, high density polyethylene (HDPE), heat resistant hard polyvinyl chloride, and polyacetal (POM), and more preferably high density polyethylene (HDPE), in terms of chemical resistance, abrasion resistance, and heat resistance.

A plurality of conductive media flowably accommodated in the first insulating container(s) and in the second insulating container(s) are in electrical contact with the negative electrode, so that power can be supplied from the negative electrode to each metal element via the conductive media. The negative electrode may be disposed at a non-limiting position, but it is desirable to dispose the negative electrode at a position where the electrical contact with each conductive medium is not interrupted in each insulating container.

For example, when using a fixed cell type electroplating device as described below, the fastener chain passing through the first insulating container(s) and the second insulating container(s) in the horizontal direction leads to movement of the conductive media to the front side in the conveying direction and to accumulation there. The fastener chain passing through the first insulating container(s) and the second insulating container(s) vertically upward leads to tendency of the conductive media accumulated downward.

Therefore, when the fastener chain passes in the horizontal direction, the negative electrode is preferably disposed at least on the front inner side in the conveying direction where the conductive media are easily accumulated, among the inner sides of the insulating container(s). When the fastener chain passes vertically upward, the negative electrode is preferably disposed at least on the lower inner sides of the insulating container(s) where the conductive media are easily accumulated, among the inner sides of the insulating container(s). The shape of the negative electrode is not particularly limited, and it may be, for example, a plate shape.

The fastener chain can also travel in an oblique direction in the middle of the horizontal direction and the vertical direction. In this case, the position where the conductive media are easily accumulated varies depending on the inclination, traveling speed, number and size of the conductive media. Therefore, the position where the positive electrode is disposed may be adjusted according to the actual conditions.

The conductive media are flowable in each insulating container, and as the fastener chain travels, the conductive media constantly changes the contact position with each metal element while being flowed and/or rotated and/or moved up and down. This can allow growth of a plating film having high uniformity because the position of current passing and the contact resistance are also changed constantly. The shape of each conductive medium is not limited as long as the conductive media are contained in the container(s) in a flowable state, but preferably it is spherical in terms of flowability.

An optimum dimension of each conductive medium varies depending on a chain width of the fastener chain, as well as a width and pitch of the slider sliding direction of the elements. When using a fixed cell type electroplating device as described below, the diameter of each conducive medium is preferably equal to or more than the chain thickness in order to prevent the conductive media from entering the traveling path of the fastener chain and the traveling path from being clogged by the conductive media while the fastener chain passes through the first insulating container(s) and the second insulating container(s).

The number of conductive media to be accommodated in the first insulating container(s) and the second insulating container(s) is not particularly limited, and is preferably set as needed in view of being able to supply power to each metal element of the fastener chain, in particular of ensuring a sufficient quantity of the conductive media to maintain constant contact with each metal element during passing through the first insulating container(s) and the second insulating container(s) even if the conductive media move in the traveling direction. On the other hand, it is preferable that an appropriate pressing pressure is applied from the conductive media to each metal element of the fastener chain because it allows facilitation of flow of electricity, but an excessive pressing pressure increases conveying resistance to hinder smooth conveying of the fastener chain. Therefore, it is preferable that the fastener chain can smoothly pass through the first insulating container(s) and the second insulating container(s) without experiencing the excessive conveying resistance. From the above point of view, illustratively, the quantity of the conductive media accommodated in each insulating container is preferably such that 3 or more layers (in other words, a lamination thickness of 3 or more times as large as the diameter of the conductive medium), and typically from 3 to 8 layers (in other words, a lamination thickness of from 3 to 8 times as large as the diameter of the conductive medium) can be formed when the conductive media spread over the metal elements.

When using a fixed cell type electroplating device as described below, the horizontal passing of the fastener chain through the first insulating container(s) and the second insulating container(s) moves the conductive media to the front in the conveying direction to facilitate accumulation. Thus, the weight of the conductive media accumulated in the front presses the fastener chain, and the conveying resistance to the fastener chain increases. Further, when current flows from the negative electrode to the conductive media, a longer length of a cell drops voltage, thereby decreasing a plating efficiency. Therefore, the connecting of two or more of each of the first insulating container(s) and the second insulating container(s) in series can allow a decrease in conveying resistance due to the weight of the conductive media, and can allow an increased plating efficiency. It is also possible to adjust the thickness of the plating film and the traveling speed of the fastener chain by increasing or decreasing the number of two or more of insulating containers connected in series.

In terms of reducing the conveying resistance, it is desirable to provide an upward angle in the traveling direction of the fastener chain passing through each insulating container, that is, the fastener chain passing through each insulating container while rising. Thus, the conductive media which are easy to move in the conveying direction falls to the rear in the conveying direction due to its own weight, so that the conductive media are not likely to accumulate at the front of the conveying direction. The inclination angle may be appropriately set according to the conveying speed, the size and number of conductive media, and the like. When the conductive media are spherical and the quantity of the conductive media are such that from 3 to 8 layers can be formed over the metal elements, the inclination angle is preferably 9° or more, and typically 9° or more and 45° or less, in terms of maintaining the contact of the conductive media with the metal elements passing through the first insulating container(s) and the second insulating container(s) even if the conductive media move in the traveling direction during traveling of the fastener chain.

In terms of designing a more compact plating device, there is also a method in which the fastener chain passes through each insulating container while rising in the vertical direction. According to the method, the plating bath is elongated in the vertical direction and shortened in the horizontal direction, so that a footprint for disposing the plating device can be reduced.

In one embodiment of the plating method according the present invention, during the fastener chain passing through the first insulating container(s), power is supplied by mainly bringing the surface of each metal element exposed on the first main surface side of the fastener chain into contact with the conductive media in the first insulating container(s). During the step, the first positive electrode is disposed in a positional relationship so as to face the surface of each metal element exposed on the second main surface side of the fastener chain, so that regular flows of cations and electrons are generated, and a plating film can be rapidly grown on the surface side of each metal element exposed on the second main surface side of the fastener chain. In terms of suppressing the plating of the conductive media, the first positive electrode should be preferably disposed only in the positional relationship so as to face the surface of each metal element exposed on the second main surface side of the fastener chain.

Further, in another embodiment of the plating method according to the present invention, during the fastener chain passing through the second insulating container(s), power is supplied by mainly bringing the surface of each metal element exposed on the second main surface side of the fastener chain into contact with the conductive media in the second insulating container(s). During the step, the second positive electrode is disposed at a positional relationship so as to face the surface of each metal element exposed on the first main surface of the fastener chain, so that regular flows of cations and electrons are generated, and a plating film can be rapidly grown on the surface of each metal element exposed on the first main surface side of the fastener chain. In terms of suppressing the plating on excessive areas other than the elements, the second positive electrode should be preferably disposed only in the positional relationship so as to face the surface of each metal element exposed on the first main surface side of the fastener chain.

When a plurality of conductive media is randomly brought into contact with both of the main surfaces of the fastener chain, flows of cations and electrons will also be random, so that a growth speed of an electroplating film is slow down. Therefore, it is preferable that the surface exposed on one main surface side is preferentially contacted with the conductive media as much as possible. Therefore, during the fastener chain passing through the first insulating container(s), 60% or more, and preferably 80% or more, and more preferably 90% or more, and even more preferably all of the total number of conductive media in the first insulating container(s) are configured to be contactable with the surface of each metal element exposed on the first main surface side of the fastener chain. The expression "all of the conductive media in the first insulating container(s) are configured to be contactable with the surface of each metal element exposed on the first main surface side of the fastener chain" means that only the surface of the metal elements exposed on the first main surface side is brought into contact with the conductive media in the first insulating container(s).

Similarly, during the fastener chain passing through the second insulating container(s), 60% or more, and preferably 80% or more, and more preferably 90% or more, and even more preferably all of the total number of conductive media in the second insulating container(s) are configured to be contactable with the surface of each metal element exposed on the second main surface side of the fastener chain. The expression "all of the conductive media in the second insulating container(s) are configured to be contactable with the surface of each metal element exposed on the second main surface side of the fastener chain" means that only the surface of the metal elements exposed on the second main surface side is brought into contact with the conductive media in the second insulating container(s).

The shortest distance between the surface of each metal element exposed on the second main surface side of the fastener chain and the first positive electrode, and the shortest distance between the surface of each metal element exposed on the first main surface side of the fastener chain and the second positive electrode are preferably shorter, respectively, because they can allow efficient plating on each metal element and can allow suppression of plating on unnecessary portions (for example, conductive media). The increased plating efficiency can save maintenance costs, chemicals and electricity for the conductive media. Specifically, the shortest distance between each metal element and the positive electrode is preferably 10 cm or less, and more preferably 8 cm or less, and still more preferably 6 cm or less, and even more preferably 4 cm or less. In this case, it is desirable from the viewpoint of plating efficiency that the first positive electrode and the second positive electrode be disposed so as to extend in parallel to the fastener chain conveying direction.

(3. Plating Device)

Now, embodiments of an electroplating device suitable for carrying out the electroplating method as stated above will be described. However, the descriptions of the same components as those described in the embodiments of the electroplating method also apply to those of the embodiments of the electroplating device, and redundant descriptions will be thus omitted in principle.

In one embodiment, the electroplating device according to the present invention includes: a plating bath capable of accommodating a plating solution;

a first positive electrode disposed in the plating bath; and one or more first insulating container(s) disposed in the plating bath, each of the first insulating container(s) flowably accommodating a plurality of conductive media in electrical contact with a negative electrode.

In the present embodiment, the first insulating container(s) is configured to enable the fastener chain to pass through the first insulating container(s) while mainly bringing a surface of each metal element exposed on the first main surface side of the fastener chain into contact with the conductive media in the first insulating container(s). Further, in the present embodiment, the first positive electrode is disposed in a positional relationship so as to face the surface of each metal element exposed on the second main surface side of the fastener chain during the fastener chain passing through the first insulating container(s). According to the present embodiment, the surfaces of the element rows exposed on the second main surface side of the fastener chain can be mainly plated.

In another embodiment, the electroplating device according to the present invention further includes:

a second positive electrode disposed in the plating bath; and one or more second insulating container(s) disposed in the plating bath, each of the second insulating container(s) flowably accommodating a plurality of conductive media in electrical contact with a negative electrode.

In the present embodiment, the second insulating container(s) are configured to enable the fastener chain to pass through each of the second insulating container(s) while mainly bringing a surface of each metal element exposed on the second main surface side of the fastener chain into contact with the conductive media in the second insulating container(s). Further, in the present embodiment, the second positive electrode is disposed in a positional relationship so as to face the surface of each metal element exposed on the first main surface side of the fastener chain during passing the fastener chain through the second insulating container(s). According to the present embodiment, the surfaces of the element rows exposed on both main surface sides of the fastener chain can be plated.

Figure 6:
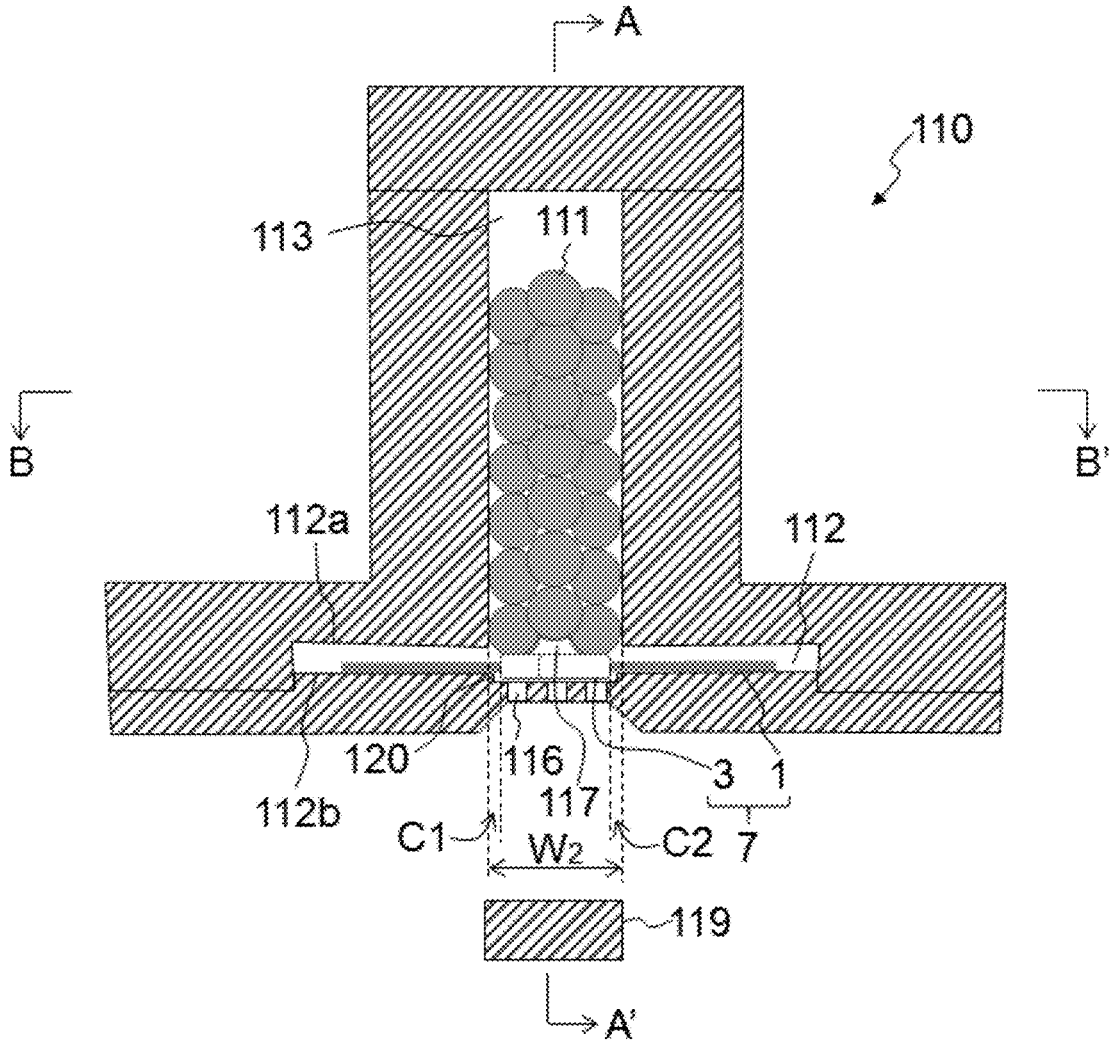
FIG. 6 is a cross-sectional view of an insulating container as viewed from a direction facing a conveying direction of a fastener chain when the fastener chain straightly passes through the insulating container of a fixed cell type plating device.
Figure 7:
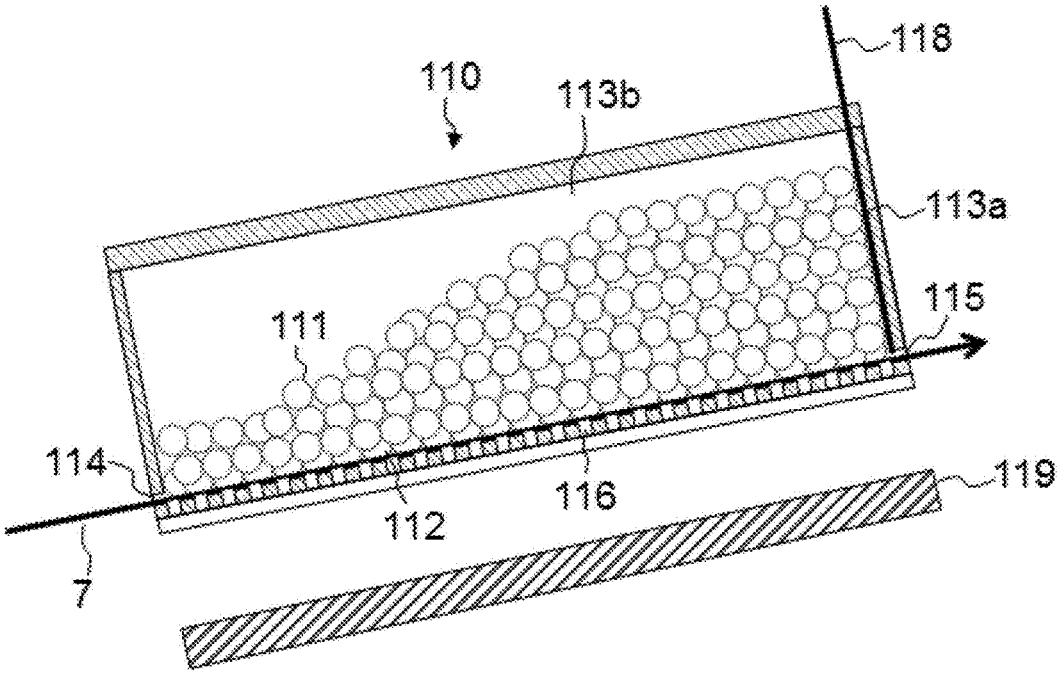
FIG. 7 is a schematic cross-sectional view taken along the line A-A' of the insulating container shown in FIG. 6.
Figure 8:
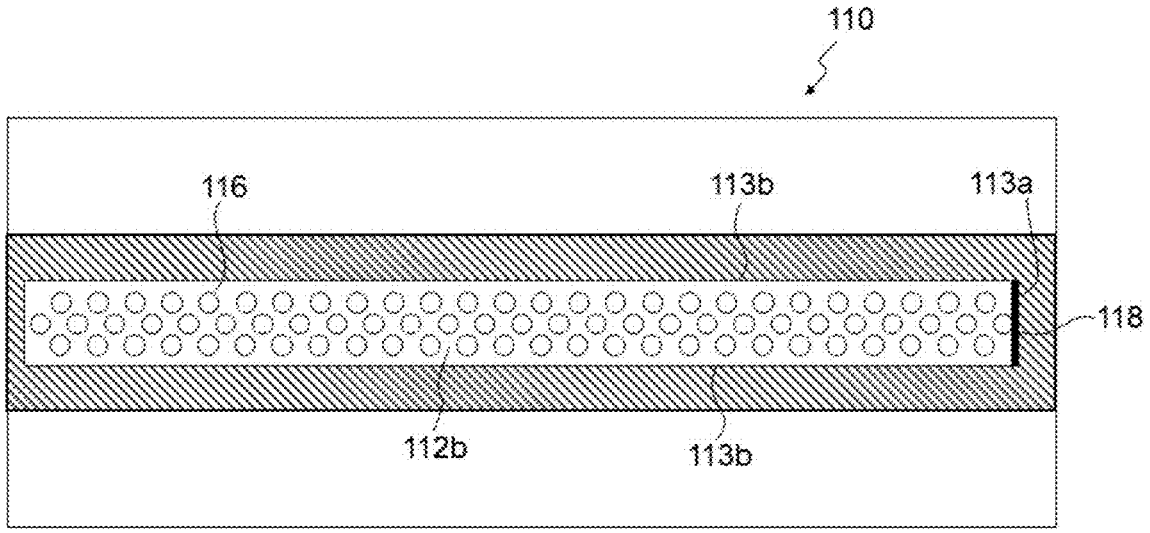
FIG. 8 is a schematic cross-sectional view taken along the line B-B' when conductive media and a fastener chain are removed from the insulating container shown in FIG. 6.

Now, a fixed cell type electroplating device which is a specific example of the electroplating device according to the present invention will be described. The fixed cell type is advantageous in that only the surface of each metal element exposed on one of the main surfaces can be brought into contact with the conductive media in the insulating container(s). In the fixed cell type plating device, the insulating container(s) is fixed in the plating device and does not involve movement such as rotation. The structure of the insulating container (which can be used for any of the first and second insulating container(s)) in a structural example of the fixed cell type plating device is schematically shown in FIGS. 6 to 8. FIG. 6 is a schematic cross-sectional view of the insulating container of the fixed cell type plating device as viewed from a direction facing the conveying direction of the fastener chain. FIG. 7 is a schematic cross-sectional view taken along the line A-A' of the insulating container shown in FIG. 6. FIG. 8 is a schematic cross-sectional view taken along the line B-B' when the conductive media and the fastener chain are removed from the insulating container shown in FIG. 6.

Referring to FIGS. 6 and 7, an insulating container 110 includes: a passage 112 for guiding a traveling path of a fastener chain 7; and an accommodating portion 113 for flowably accommodating a plurality of conductive media 111, inside the insulating container 110. The passage 112 includes: an inlet 114 for the fastener chain; an outlet 115 for the fastener chain; one or more opening(s) 117 on a passage surface 112*a* on a side opposing to one (first or second) main surface side of the fastener chain 7, the opening(s) 117 enabling access to the conductive media 111; and one or more opening(s) 116 on a passage surface 112*b* facing the other (second or first) main surface side of the fastener chain 7, the opening(s) 116 enabling fluid communication with the plating solution and current flow. The passage surface 112*b* may be provided with a guide groove 120 extending along the conveying direction for guiding the conveying direction of the metal elements 3.

One or more opening(s) 117 enabling access to the conductive media 111 preferably satisfies the relationship: $2D<W_2<3D$, more preferably $2.1D\leq W_2\leq 2.8D$, in which $W_2$ represents a width in a chain width direction, and D represents a diameter of the conductive medium 111, because power supply is easily stabilized while ensuring a space for movement and rotation of the balls when arranging three balls in the chain width direction so as to partially overlap with one another. Here, the chain width refers to a width of the engaged elements as defined in JIS 3015: 2007. Further, the diameter of the conductive medium is defined as a diameter of a true sphere having the same volume as the conductive medium to be measured.

The fastener chain 7 entering the insulating container 110 from the inlet 114 travels in the direction of the arrow in the passage 112 and exits the outlet 115. While the fastener chain 7 passes through the passage 112, the conductive media 111 held in the accommodating portion 113 can be brought into contact with the surface of each metal element 3 exposed on one main surface side of the fastener chain 7 through the opening(s) 117. However, there is no opening where the conductive media 111 can access the surface of each metal element 3 exposed on the other main surface side of the fastener chain 7. Therefore, the conductive media 111 held in the accommodating portion 113 cannot be brought into contact with the surface of each metal element 3 exposed on the other main surface side of the fastener chain 7.

The conductive media 111 are dragged by the fastener chain 7 traveling in the passage 112 and moved to the front in the conveying direction and are likely to accumulate there. However, excessive accumulation leads to clogging of the conductive media 111 at the front and to strong pressing of the fastener chain 7, so that the conveying resistance of the fastener chain 7 is increased. Therefore, as shown in FIG. 7, the outlet 115 is provided at a position higher than the inlet 114 to incline the passage 112 upward, whereby the conductive media 111 contained in the insulating container 110 is returned back in the conveying direction, so that the conveying resistance can be reduced. It is also possible to provide the outlet 115 vertically above the inlet 114 so that the conveying direction of the fastener chain 7 is vertically upward, which makes it easy to control the conveying resistance and provides an advantage of only requiring a small footprint.

Referring to FIG. 8, a plate-shaped negative electrode 118 is disposed on a front inner side 113*a* in the conveying direction among inner sides of the accommodating portion 113. The conductive media 111 can be in electrical contact with the plate-shaped negative electrode 118. Further, while the fastener chain 7 passes through the passage 112, the conductive media 111 can be electrically contacted with the surface of each metal element 3 exposed on one main surface side of the fastener chain 7. When at least a portion of the conductive media 111 is electrically contacted with both of those conductive media 111 to create an electrical path, power can be supplied to the respective metal elements 3 while the fastener chain 7 passes through the passage 112.

In a typical embodiment, the fastener chain 7 is electroplated while being immersed in a plating solution. While the fastener chain 7 passes through the passage 112 of the insulating container 110, the plating solution can be contacted with each metal element 3 by entering the passage 112 through the opening(s) 116. By providing an positive electrode 119 on a side facing the other (second or first) main surface side of the fastener chain 7, cations in the plating solution efficiently reach the other main surface side of the fastener chain, so that the plating film can be rapidly grown on the surface of each metal element 3 exposed on the main surface side.

It is advantageous for smooth conveying of the fastener chain 7 that the opening(s) 116 formed on the passage surface 112*b* is provided so as not to catch the fastener chain 7 traveling in the passage 112. From this point of view, each opening 116 is preferably a circular hole, and can be, for example, a circular hole with a diameter of from 1 to 3 mm.

Further, it is preferable to provide the opening(s) 116 formed on the passage surface 112*b* so that electricity flows with high uniformity throughout the metal elements 3 of the fastener chain 7 traveling in the passage 112 in order to obtain a highly uniform plating film. From such a point of view, a ratio of an area of the opening(s) 116 to an area including the opening(s) 116 on the passage surface 112*b* (hereinafter referred to as an opening ratio) is preferably 40% or more, and more preferably 50% or more. However, the opening ratio is preferably 60% or less, for reasons of ensuring strength. Further, as shown in FIG. 8, the opening(s) 116 are preferably arranged along the conveying direction of the fastener chain 7 (three rows in FIG. 8), and are more preferably arranged in a staggered array from the viewpoint that current flows on the entire exposed surface of the metal elements 3 to facilitate plating.

Preferably, the conductive media 111 are not contacted with the fastener tape 1 while the fastener chain 7 travels in the passage 112. This is because when the conductive media 111 are contacted with the fastener tape 1, the conveying resistance of the fastener chain is increased. Therefore, the opening(s) 117 are preferably disposed at a position where the conductive media 111 cannot be contacted with the fastener tape. When viewing the insulating container from the direction facing the conveying direction of the fastener chain (see FIG. 6), each of gaps C1 and C2 in the chain width direction from both side walls of the opening 117 to both ends of the metal element 3 is preferably equal to or less than the radius of each conductive medium. However, a narrower distance between both side walls of the opening 117 leads to a decreased contact frequency of the conductive media 111 with the elements 3. Therefore, each of the gaps C1 and C2 is preferably 0 or more, and more preferably larger than 0. The radius of the conductive medium is defined as a radius of a true sphere having the same volume as that of the conductive medium to be measured.

Preferably, the distance between the passage surface 112*a* and the passage surface 112*b* is shorter than the diameter of the conductive medium so that the conductive medium does not enter the passage 112. This is because if the conductive medium enters the passage 112, the conveying resistance is significantly increased, which causes the conveying of the fastener chain 7 to be difficult.

Figure 9:
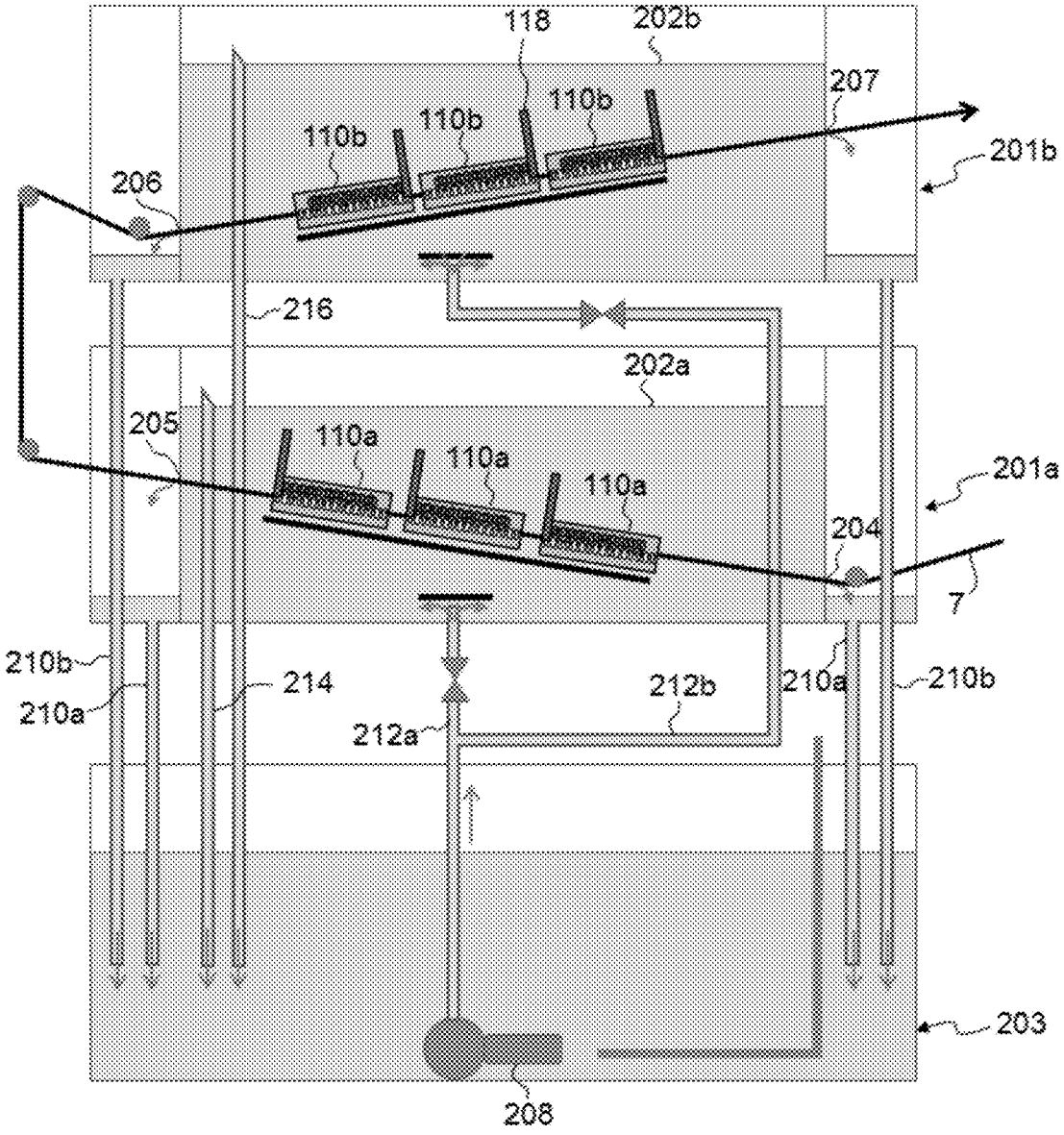
FIG. 9 shows an overall structural example of a fixed cell type electroplating device according to the present invention.

FIG. 9 shows an example of the overall configuration of the fixed cell type electroplating device. In the embodiment shown in FIG. 9, the fastener chain 7 is conveyed in the direction of the arrow under tension in the plating bath 201 containing a plating solution 202. The tension is preferably a load of from 0.1N to 0.2N.

In the embodiment shown in FIG. 9, the plating bath 201 is divided into a first plating bath 201*a* and a second plating bath 201*b*. The fastener chain 7 enters a plating solution 202*a* from an inlet 204 provided on a side wall of the first plating bath 201*a*, passes obliquely upward through three first insulating containers 110*a* arranged in series, and exits an outlet 205 provided on the side wall of the plating bath 201*a*. The outlet 205 is at a higher position than the inlet 204. The fastener chain 7 is then turned to enter the plating solution 202*b* from an inlet 206 provided on a side wall of the second plating bath 201*b* installed above the first plating bath 201*a*, passing obliquely upward through three second insulating containers 110*b* arranged in series, and exit an outlet 207 provided on the side wall of the second plating bath 201*b*.

In the embodiment shown in FIG. 9, the plating solution overflows from the inlet 204 and the outlet 205 of the first plating bath 201*a*. The overflowing plating solution is collected in a storage tank 203 through return pipes 210*a*, and then fed again to the first plating bath 201*a* by a circulation pump 208 through a feed pipe 212*a*. Also, the plating solution overflows from the inlet 206 and the outlet 207 of the second plating bath 201*b*. The overflowing plating solution is collected in the storage tank 203 through return pipes 210*b*, and then fed again to the second plating bath 201*b* by the circulation pump 208 through a feed pipe 212*b*.

In the embodiment shown in FIG. 9, the inside of the first plating bath 201*a* is provided with a return pipe 214 for adjusting the liquid level of the plating solution 202*a*, and the inside of the second plating bath 101*b* is provided with a return pipe 216 for adjusting the liquid level of the plating solution 202*b*, which prevent the plating solution from overflowing from each plating bath (201*a*, 201*b*).

In the embodiment shown in FIG. 9, the first insulating containers 110*a* and the second insulating containers 110*b* are provided in opposite orientation relative to the respective main surfaces of the fastener chain 7. The surface of each metal element exposed on one main surface side of the fastener chain 7 is plated while passing the fastener chain 7 through the first insulating containers 110*a*, and the surface of each metal element exposed on the other main surface side of the fastener chain 7 is plated while passing the fastener chain 7 through the second insulating containers 110*b*.

In the embodiment shown in FIG. 9, the plating bath in which the first insulating containers 110*a* and the second insulating container 110*bs* are accommodated is separated. Therefore, both can be immersed in the plating solution having the same composition. However, by arranging both in the plating baths containing plating solutions having different compositions, one main surface can be plated with a color different from the other main surface.

EXAMPLES

Hereinafter, Examples of the present invention are illustrated, but they are provided for better understanding of the present invention and its advantages, and are not intended to limit the present invention.

Comparative Example 1: Power Supply Drum Type

Using a feeding drum type plating device as described in FIG. 7 of Japanese Examined Patent Application Publication No. H08-3158B, electroplating was continuously performed on metal elements exposed on both main surface sides of the fastener chain being conveyed.

The plating conditions were as follows:

Fastener chain specification: model 5 RG chain (a chain width: 5.75 mm; element material: red brass; fastener tape material: polyester) from YKK Corporation:

Plating solution: 5 L; composition: a plating solution for nickel plating;

Feeding drum specification: material titanium, with a diameter of 100 mm;

Retention time in plating solution: 18.8 seconds; and

Conveying speed: 1 m/min.

Example 1: Fixed Cell Type

Insulating containers each having the structure shown in FIGS. 6 to 8 were produced according to the following specifications:

Conductive Media: 300 iron balls having a copper pyrophosphate plating film with thickness of about 3 μm on the surface, and having a diameter of 8 mm; number of laminated layers=4;

Insulating Container: made of an acrylic resin;

Inclination Angle: 3°;

Openings 116: 54% opening ratio; circular holes having a diameter of 2 mm, arranged in a staggered pattern;

Gaps C1, C2: 4 mm;

Width $W_2$: 17 mm.

The electroplating device shown in FIG. 9 was constructed using the above insulating containers, and electroplating was continuously performed on the metal elements exposed on both main surface sides of the fastener chain being conveyed.

Plating conditions are as follows:

Fastener Chain Specification: model 5 RG chain (chain width: 5.75 mm, element material: red brass; fastener tape material: polyester) from YKK Corporation;

Plating Solution: 120 L, composition: a plating solution for non-cyan Cu—Sn alloy plating;

Plating Time: 14.4 seconds.

Conveying Speed: 2.5 m/min; and

The shortest distance between each element and positive Electrode: 3 cm.

(Measurement of Plating Film Thickness)

In Comparative Example 1, one fastener stringer forming the resulting plated fastener chain had 2n (n=100) metal elements along one side edge of the fastener tape in the longitudinal direction, and ten adjacent metal elements from the n−4$^{th}$ to the n+5$^{th}$ aligned side by side were extracted.

Then, the thickness of the plating film at the element center (on either one main surface side of the fastener chain) was measured for each of the ten metal elements aligned side by side with fluorescent X ray analysis. Measurement conditions were as follows: voltage: 50 kV, current: 1000 μA, measurement time: 120 seconds, and collimator: 0.2 mmφ.

In Example 1, one fastener stringer forming the resulting plated fastener chain had 2n (n=100) metal elements along one side edge of the fastener tape in the longitudinal direction, and ten adjacent metal elements from the n−4$^{th}$ to the n+5$^{th}$ aligned side by side were extracted. Then, the thickness of the plating film at the element center (on either one main surface side of the fastener chain), at the top of the convex portion and at the deepest point of the concave portion of the head portion was measured for each of the ten metal elements arranged side by side by obtaining an elemental depth profile with Auger electron spectroscopy (AES) (Model JAMP 9500F from JEOL Ltd.) according to the measurement conditions as described earlier. The results are shown in Tables 1-1 and 1-2. Although the plating thickness measurement method of Comparative Example 1 is different from that of Example 1, it is presumed that there is no significant difference even if it is measured by the measurement method of Example 1.

In addition, for both of the fastener chains of Comparative Example 1 and Example 1, no plating film was formed on the portion of the surface of the element that is hidden by contact with the fastener tape.

TABLE 1-1

Comparative Example 1

| | Plating Thickness at Element | | Plating Thickness of Head Portion | | | |
|---|---|---|---|---|---|---|
| | Center of One Main Surface Side | | Top of Convex Portion | | Deepest Point of Concave Portion | |
| Element No. | $D_1$ (μm) | $D_1/A_1$ | (μm) | Ratio to $D_1$ | (μm) | Ratio to $D_1$ |
| 1 | 0.73 | 2.116 | 0.07 | 0.096 | 0.00 | 0.000 |
| 2 | 0.00 | 0.000 | 0.00 | | 0.00 | |
| 3 | 0.34 | 0.986 | 0.05 | 0.147 | 0.02 | 0.059 |
| 4 | 0.16 | 0.464 | 0.02 | 0.125 | 0.00 | 0.000 |
| 5 | 0.17 | 0.493 | 0.07 | 0.412 | 0.00 | 0.000 |
| 6 | 0.00 | 0.000 | 0.00 | | 0.00 | |
| 7 | 0.20 | 0.580 | 0.02 | 0.100 | 0.00 | 0.000 |
| 8 | 0.07 | 0.203 | 0.00 | 0.000 | 0.00 | 0.000 |
| 9 | 0.88 | 2.551 | 0.05 | 0.057 | 0.00 | 0.000 |
| 10 | 0.90 | 2.609 | 0.35 | 0.389 | 0.08 | 0.089 |
| Average Value | $A_1$ = 0.345 | | 0.063 | | 0.010 | |

TABLE 1-2

Example 1

| | Plating Thickness at Element | | Plating Thickness of Head Portion | | | |
|---|---|---|---|---|---|---|
| | Center of One Main Surface Side | | Top of Convex Portion | | Deepest Point of Concave Portion | |
| Element No. | $D_1$ (μm) | $D_1/A_1$ | (μm) | Ratio to $D_1$ | (μm) | Ratio to $D_1$ |
| 1 | 0.096 | 1.337 | 0.046 | 0.48 | 0.042 | 0.44 |
| 2 | 0.056 | 0.780 | 0.040 | 0.71 | 0.026 | 0.46 |
| 3 | 0.056 | 0.780 | 0.036 | 0.64 | 0.034 | 0.61 |
| 4 | 0.074 | 1.031 | 0.062 | 0.84 | 0.058 | 0.78 |
| 5 | 0.09 | 1.253 | 0.068 | 0.76 | 0.048 | 0.53 |
| 6 | 0.054 | 0.752 | 0.07 | 1.30 | 0.076 | 1.41 |
| 7 | 0.074 | 1.031 | 0.074 | 1.00 | 0.054 | 0.73 |

TABLE 1-2-continued

| Example 1 | | | | | | |
|---|---|---|---|---|---|---|
| | Plating Thickness at Element | | Plating Thickness of Head Portion | | | |
| | Center of One Main Surface Side | | Top of Convex Portion | | Deepest Point of Concave Portion | |
| Element No. | $D_1$ (μm) | $D_1/A_1$ | (μm) | Ratio to $D_1$ | (μm) | Ratio to $D_1$ |
| 8 | 0.06 | 0.836 | 0.068 | 1.13 | 0.042 | 0.70 |
| 9 | 0.09 | 1.253 | 0.068 | 0.76 | 0.052 | 0.58 |
| 10 | 0.068 | 0.947 | 0.074 | 1.09 | 0.054 | 0.79 |
| Average Value | $A_1$ = 0.0718 | | 0.0606 | | 0.0486 | |

Discussion

It is understood that the fastener chain of Example 1 is provided with metal element rows having high uniformity of the thickness of the plating film, even if the elements are not electrically connected to each other in advance. Further, it is understood that the fastener chain of Example 1 has the high plating deposition property at the engaged portions (the convex portion and the concave portion) of each element head, even if the elements are not electrically connected to each other in advance. In fact, when the ten elements for measuring the thickness were observed using a microphotograph, the Cu—Sn alloy was not formed in the contact portion with the fastener tape and red brass color of the base material appeared, but the Cu—Sn alloy plating was formed on all of the portions that were not in contact with the fastener tape. Moreover, the plating film was formed in the convex portion and the concave portion of the head portion of all the observed elements, so that the base material did not appear thereon.

On the other hand, the fastener chain of Comparative Example 1 had many variations in the thickness of the plating film, and a poor plating deposition property at the engaged portion of the head portion of each element. When the ten elements for measuring the thickness were observed using a photomicrograph, the convex portion and the concave portion of the head portion of some of the elements were not plated at all and the red brass color of the base material appeared. Further, it was observed that the base material appeared even if the plating film was partially formed on the convex portion and the concave portion of the head portion of the element.

For the fastener chain of Example 1, the plating film was also evaluated by extracting multiple sets of adjacent ten fastener elements, in addition to the ten elements at the central portion as described above. Similar results were obtained.

DESCRIPTION OF REFERENCE NUMERALS

1 fastener tape
2 core portion
3 element
4 upper stopper
5 lower stopper
6 slider
7 fastener chain
8 deformed wire
9 head portion
9*a* convex portion
9*b* concave portion
10 leg portion
11 rectangular wire
12 deformed wire
110 insulating container
110*a* first insulating container
110*b* second insulating container
111 conductive medium
112 passage
112*a* passage surface facing one main surface side of fastener chain
112*b* passage surface facing the other main surface of the fastener chain
113 accommodating portion
113*a* front inner side in the conveying direction of accommodating portion
113*b* inner side parallel to conveying direction of accommodating portion
114 inlet to passage
115 outlet from passage
116 opening
117 opening
118 negative electrode
119 positive electrode
120 guide groove
121 partition plate
201 (201*a*, 201*b*) plating bath
202 (202*a*, 202*b*) plating solution
203 storage tank
204, 206 plating bath inlet
205, 207 plating bath outlet
208 circulating pump
210 (210*a*, 210*b*), 214, 216 return pipe
212 feed pipe

What is claimed is:

1. A fastener stringer comprising a row of metal elements having a plating film, the metal elements being fixed at predetermined intervals on one side edge of a fastener tape in a longitudinal direction, wherein a portion of the fastener tape in contact with each of the metal elements has insulation properties;

wherein each of the metal elements comprises: a pair of leg portions; and a head portion connecting the pair of leg portions, the head portion comprising a convex portion and a concave portion for engagement;

the plating film is not formed on a portion which is hidden by contact with the fastener tape, among the surface of each of the metal elements;

the row of the metal elements is composed of 2n or 2n+1 metal elements in which n is an integer of 5 or more; and each of ten adjacent metal elements from the $n-4^{th}$ to the $n+5^{th}$ in the longitudinal direction from either one end of the row of metal elements satisfies a relationship: $0.6 \leq D_1/A_1 \leq 2.0$, in which $A_1$ represents an average value of thickness of the plating film for the ten metal elements at element center on either one main surface side of the fastener tape, and $D_1$ represents thickness of the plating film for each of the ten metal elements at the element center on the one main surface side of the fastener tape.

2. The fastener stringer according to claim 1, wherein the average value $A_1$ of the thickness of the plating film is 0.05 μm or more.

3. The fastener stringer according to claim 1, wherein for each of the ten metal elements, the plating film is formed such that a base material is not exposed at the top of the convex portion and at the deepest point of the concave portion of the head portion.

4. The fastener stringer according to claim 1, wherein for each of the ten metal elements, thickness of the plating film at the top of the convex portion and at the deepest point of the concave portion of the head portion is respectively 30% or more relative to the thickness $D_1$ of the plating film at the element center on the one main surface side.

5. The fastener stringer according to claim 1, wherein for each of the ten metal elements, thickness of the plating film at the top of the convex portion and at the deepest point of the concave portion of the head portion is 0.02 μm or more, respectively.

6. A fastener stringer comprising a row of metal elements having a plating film, the metal elements being fixed at predetermined intervals on one side edge of a fastener tape in a longitudinal direction, wherein a portion of the fastener tape in contact with each of the metal elements has insulation properties;

each of the metal elements comprises: a pair of leg portions; and a head portion connecting the pair of legs, the head portion comprising a convex portion and a concave portion for engagement;

the plating film is not formed on a portion which is hidden by contact with the fastener tape, among the surface of each of the metal elements;

the row of the metal elements is composed of 2n or 2n+1 metal elements in which n is an integer of 5 or more; and for each of ten adjacent metal elements from the $n-4^{th}$ to the $n+5^{th}$ in the longitudinal direction from either one end of the row of metal elements, the plating film is formed such that a base material is not exposed at the top of the convex portion and at the deepest point of the concave portion of the head portion.

7. The fastener stringer according to claim 6, wherein for each of the ten metal elements, the thickness of the plating film at the top of the convex portion and at the deepest point of the concave portion of the head portion is respectively 30% or more relative to $D_1$, which represents thickness of the plating film for each of the metal elements at the element center on either one main surface side of the fastener tape.

8. The fastener stringer according to claim 6, wherein for each of the ten metal elements, the thickness of the plating film at the top of the convex portion and at the deepest point of the concave portion of the head portion is 0.02 μm or more, respectively.

9. The fastener stringer according to claim 6, wherein each of the ten adjacent metal elements satisfies a relationship: $0.6 \leq D_1/A_1 \leq 2.0$, in which $A_1$ represents an average value of thickness of the plating film for the ten metal elements at element center on either one main surface side of the fastener tape, and $D_1$ represents thickness of the plating film for each of the metal elements at the element center on the one main surface side of the fastener tape.

10. The fastener stringer according to claim 9, wherein the average value $A_1$ of the thickness of the plating film is 0.05 μm or more.

11. The fastener stringer according to claim 1, wherein the plating film is formed on an entire exposed surface of each of the ten metal elements.

12. The fastener stringer according to claim 1, wherein the plating film is formed after the row of metal elements is fixed to one side edge of the fastener tape in the longitudinal direction at predetermined intervals.

13. A fastener chain comprising engaged rows of opposing metal elements of a pair of fastener stringers, wherein each of the fastener stringers is the fastener stringer according to claim 1.

14. A slide fastener comprising the fastener chain according to claim 13.

15. An article comprising the slide fastener according to claim 14.

16. The fastener stringer according to claim 6, wherein the plating film is formed on an entire exposed surface of each of the ten metal elements.

17. The fastener stringer according to claim 6, wherein the plating film is formed after the row of metal elements is fixed to one side edge of the fastener tape in the longitudinal direction at predetermined intervals.

18. A fastener chain comprising engaged rows of opposing metal elements of a pair of fastener stringers, wherein each of the fastener stringers is the fastener stringer according to claim 6.

19. A slide fastener comprising the fastener chain according to claim 18.

20. An article comprising the slide fastener according to claim 19.

* * * * *